US005150046A

United States Patent [19]

Lim

[11] Patent Number: 5,150,046

[45] Date of Patent: Sep. 22, 1992

[54] NOISE-SHIELDED TRANSFORMER

[75] Inventor: Seok G. Lim, Inchon, Rep. of Korea

[73] Assignee: Goldstar Electric Machinery Co., Rep. of Korea

[21] Appl. No.: 702,231

[22] Filed: May 17, 1991

[30] Foreign Application Priority Data

Dec. 17, 1990 [KR] Rep. of Korea ..... 20058/1990

[51] Int. Cl.[5] ..... H01F 15/04; H01F 27/33

[52] U.S. Cl. ..... 323/356; 336/69; 336/84 C

[58] Field of Search ..... 336/69, 70, 84 R, 84 C; 323/355, 356

[56] References Cited

U.S. PATENT DOCUMENTS

| | | | |
|---|---|---|---|
| 2,553,324 | 5/1951 | Lord . | |
| 3,299,384 | 1/1967 | Lee | 336/171 |
| 4,089,049 | 5/1978 | Suzuki et al. | 363/17 |
| 4,518,941 | 5/1985 | Harada | 336/69 |

*Primary Examiner*—William H. Beha, Jr.

*Attorney, Agent, or Firm*—Ostrolenk, Faber, Gerb & Soffen

[57] ABSTRACT

A noise-shielded transformer is constructed with a toroidal core having mounted thereon a secondary winding, a bifilar shield winding, a conductive plate, an insulating member, a high voltage winding, and a primary winding. The secondary winding is located inside the other windings, making the assembly work easier and increasing the noise shielding effect. Multiple shielding, by the bifilar shield winding and the conductive plate, increases the capacitance between the secondary winding and ground and decreases the capacitance between the primary winding and the secondary winding, so that the noise eliminating characteristic with respect to pulse-property noise and high frequency-property noise is enhanced substantially. It is also possible to obtain a grounding effect and a noise-bypass effect by connecting a resonance condenser from ground to one end of the bifilar shield winding. Additional suppression of noise conduction is obtained by utilizing the high voltage winding to greatly increase the electrical potential difference between the primary winding and the secondary winding.

6 Claims, 2 Drawing Sheets

NOISE-SHIELDED TRANSFORMER

BACKGROUND OF THE INVENTION

The present invention relates to a transformer which shields its secondary electrical noises in its primary, more especially to a noise-shielded transformer which suppresses electrical noises by absorbing conductible electrical noises that flow into the power line to cause interference. A noise-generating device becomes a noise source to other peripheral electronic devices and the electrical noises from such a device, which may become a power line disturbance, is regulated as an electromagnetic interference since the electrical noises have a bad effect on other peripheral electronic devices.

Electronic devices, which are not noise-generating sources, are regulated by electromagnetic susceptibility since such electronic devices are subject to a software malfunction or a hardware breakdown due to external electrical noises.

Accordingly, measures against electrical noises are required for reliability enhancement and lifetime protection of various electronic devices. That is, a noise-shielded transformer is required which can prevent electrical noises generated by a noise-making device from flowing into other peripheral devices in order to protect them, and also protect devices used as loads against external noises.

FIG. 1 is a plan view showing a conventional noise-shielded transformer, and FIG. 2 is a circuit diagram for the transformer of FIG. 1. As shown in FIGS. 1 and 2, the conventional noise-shielded transformer shown includes a primary winding 2 having a predetermined number of turns wound around a shield winding 3 of the same number of turns as the primary winding 2 toroidal core 1. A is wound around primary winding 2. A secondary winding 4 of the same number of turns as the primary winding 2 is wound around shield winding 3, and a second shield winding 5, wound in the same manner as the first shield winding 3, is wound around secondary winding. Both ends of the first and second shield windings 3 and 5 are connected to a ground lead terminal 6.

In FIG. 2, reference numerals 7*a* and 7*b* are lead terminals of the primary winding 2 to which an AC power source is applied, and 8*a* and 8*b* are lead terminals of the secondary winding 4 which are connected to a load.

The operation of the conventional noise-shielded transformer as above is described below with reference to the equivalent circuit diagram of FIG. 3.

When an AC power source including a pulse-property noise is applied to the primary winding 2, the pulse-property noise generates a magnetic flux of a high frequency which includes current flow in the primary winding 2. At this time, the toroidal core 1 minimizes the magnetic flux of a high frequency generated by the pulse-property noise since the toroidal core 1 is made of the material that sharply decreases the magnetic permeability over high frequencies.

And, since the internal shield winding 3 is grounded, the pulse-property noise in current flowing through the primary winding 2 is directed ground through the static capacitance C of the shield winding 3.

In the meantime, since a zero potential ground line is formed around the secondary winding 4, when an external electromagnetic field acts upon primary winding 2, noise induction to the secondary winding 4 due to the external electromagnetic field can be prevented.

Also, since the first and second shield windings 3 and 5 are divided respectively into shield windings 3*a*, 3*b* and 5*a*, 5*b*, circulating current does not flow in the interior even when a bais voltage induced, and when an inequilibrium noise signal is flows between the lead terminals 7*a* and 7*b* of the primary winding 2 and the ground an inverse electromotive force is generated so as to suppress the generation of a noise voltage.

However, such a conventional noise-shielded transformer has disadvantages in that the noise-eliminating effect therein is low since the toroidal core has a very low leakage flux and it is difficult to prevent the noise induction with only the external shield winding against the external electromagnetic field, and this noise-suppressing effect is insufficient to eliminate the capacitance between the primary and secondary windings against the noise of the common mode, and the workability is not good because the internal and external shield windings 3 and 5 are divided into two halves, respectively, and are inversely connected in series.

SUMMARY OF THE INVENTION

The primary object of the present invention to provide a transformer having improved workability and noise-shielding efficiency. This is achieved by disposing a secondary winding inside of a primary winding. The grounding effect and the noise-bypass effect in terms of resonance are improved by providing a resonance condenser connected to one side of the shield windings to suppress the noise conduction by lowering the capacitance between the windings.

In another embodiment of the present invention the foregoing object is accomplished by uniformly winding a secondary winding around the toroidal core and then winding a bifilar shield winding therearound the latter has the same number of turns as the secondary winding. A conductive plate is wrapped thereon so as not to be one-turn shorted and an insulating member of a predetermined thickness is wrapped over the conductive plate, a high voltage winding is wound around the insulating member. The high voltage winding has more turns than the number of turns of the secondary winding. A primary winding having the same number of turns as the secondary winding is wound around the latter. A resonance condenser is connected to one side of the bifilar shield winding.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Figure 1:
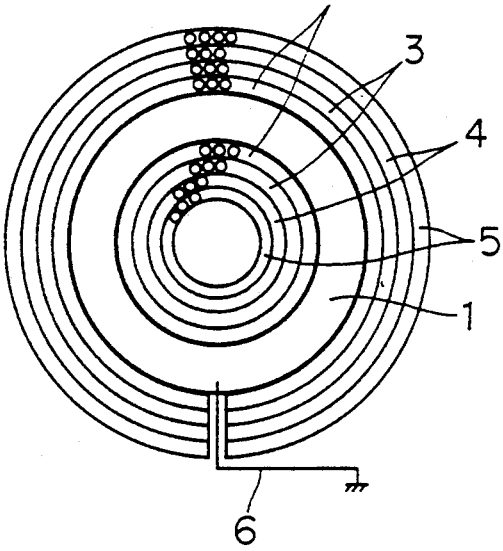
FIG. 1 PRIOR ART
FIG. 1 is a plan view showing the configuration of a conventional noise-shielded transformer.
Figure 2:
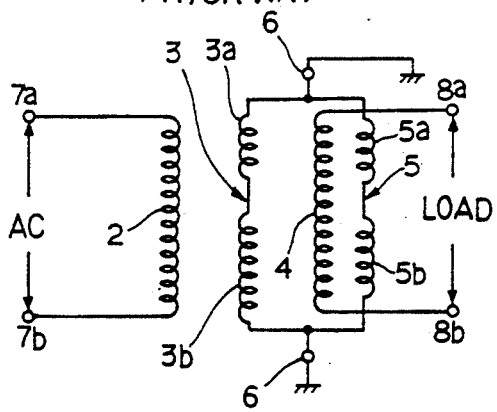
FIG. 2 PRIOR ART
FIG. 2 is a circuit diagram of the transformer of FIG. 1.
Figure 3:
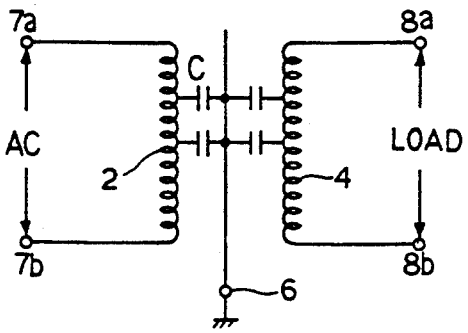
FIG. 3 PRIOR ART
FIG. 3 is an equivalent circuit diagram of FIG. 2.
Figure 4:
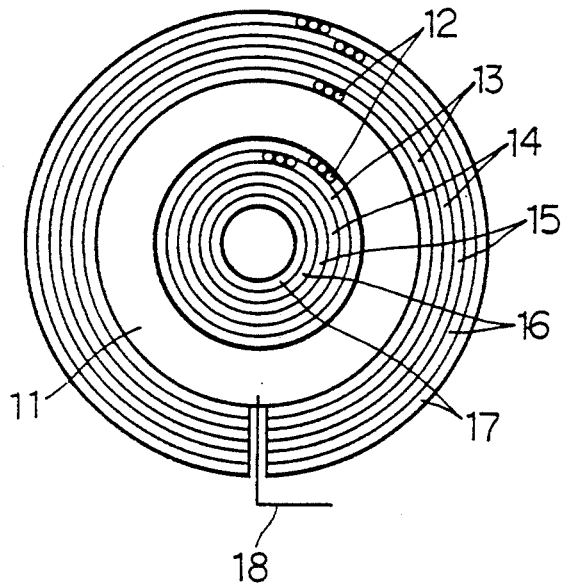
FIG. 4 is a plan view showing the configuration of a noise-shielded transformer according to the present invention.

Referring to FIG. 4, the noise-shielded transformer constructed according to the present invention includes that a secondary winding 12 is uniformly wound around the whole magnetic path field of a toroidal core 11 and a bifilar shield winding 13 having the same number of turns as the secondary winding 12 is wound around the latter. A conductive plate 14 is wrapped over the bifilar shield winding 13 so as not to be one-turn shorted, and then an insulating member 15 of a predetermined thickness is placed over the conductive plate 14, to cover the latter. A a high voltage winding 16 is wound therearound at a number of turns over the number of turns of the secondary winding 12 and then a primary winding 17 is wound therearound at the same number of turns as the number of turns of the secondary winding 12. One end of the bifilar shield winding 13 and one end of the conductive plate 14 are connected to a ground lead terminal 18.

Figure 5:
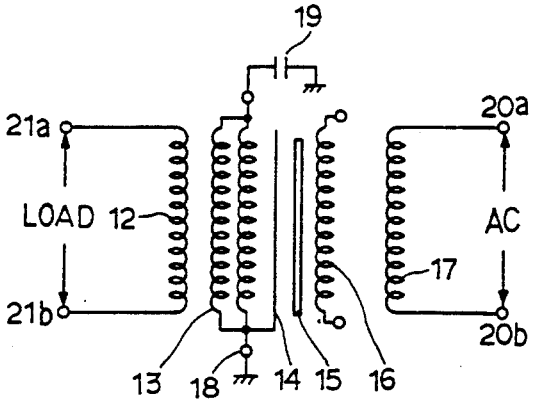
FIG. 5 is a circuit diagram of the transformer of the present invention.

Referring to FIG. 5 which shows the wiring diagram of the noise-shielded transformer of FIG. 4, terminals 20*a* and 20*b* of the primary winding 17 are connected to an alternate current source AC, lead terminals 21*a* and 21*b* of the secondary winding 12 are connected to a load, one end of the bifilar shield winding 13 and one end of the conductive plate 14 are connected to a ground lead terminal 18, the other end of the bifilar shield winding 13 is grounded through a resonance condenser 19, and both ends of the high voltage winding 16 are floated.

Figure 6:
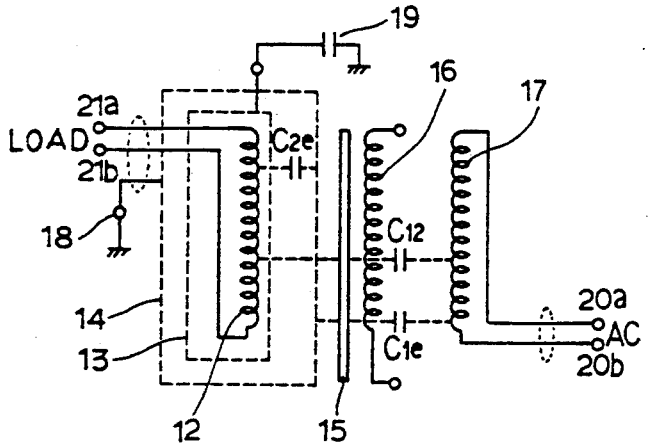
FIG. 6 is an equivalent circuit diagram of FIG. 5.

The operation and effect of the present invention will be described with reference to FIG. 6.

When a noise enters primary winding 17 from the power power source, the noise flows as a noise current in the primary winding 17 and a flux by the noise current is induced in the secondary winding 12. However, since the toroidal core 11 is for a low frequency, a high frequency flux makes the magnetro-resistance extremely higher with respect to the high frequency to minimize the effective noise so that the noise energy is absorbed as a loss of the toroidal core 11, thereby preventing the noise in the primary winding 17 from being induced into the secondary winding 12.

Conductive plate 14 permits a very large inverse high frequency current to flow when a noise flux is generated due to the noise flowing into the primary winding 17, thereby suppressing the generation of the flux by the noise current flowing into the primary winding 17.

Moreover, the bifilar shield winding 13 also permits an inverse directional electric current to flow when a noise flows into the primary winding 17 so as to suppress the flux generation, thereby minimizing the noise flux at load terminals 21*a* and 21*b* of the secondary winding 12.

In addition, the inductance of the bifilar shield winding 13 and the resonance condenser 19 are resonated with a high frequency noise, so that a very large inverse directional current-turn is formed and an inverse directional current is flows:

Thus, the generation of noise flux is surely suppressed by the bifilar shield winding 13, the conductive plate 14 and the resonance condenser 19 as above, when a noise current flows in the primary winding 17, thereby preventing a noise from being induced in the secondary winding 12.

In particular, since the conductive plate 14 isolates, magnetically, the secondary winding 12 from the primary winding 17, it is possible to surely prevent the noise flowing into the primary winding 17 from being induced in the secondary winding 12.

In the meantime, assuming that the level of a secondary induction noise is $V_2$, and the level of a noise voltage flowing into the primary winding 17 is $V_1$, a voltage-property noise flowing through the primary winding 17 and the ground can be expressed by the following expression.

$$V_2 = C_{12} \cdot V_1 / (C_{12} + C_{2e})$$

Where, $C_{12}$ is a capacitance between the primary winding 17 and the secondary winding 12, and $C_{2e}$ is a capacitance between the secondary winding 12 and the ground.

Accordingly, it is possible to reduce the amount of the capacitance of the secondary induction noise voltage $V_2$ by minimizing the capacitance $C_{12}$ and increasing the capacitance $C_{2e}$. Since the shielding is carried out by the bifilar shield winding 13 as well as the conductive plate 14, the capacitance $C_{12}$ is minimized, while the capacitance $C_{2e}$ is increased in that the conductive area between the secondary winding 12 and the ground is enlarged by the conductive plate 14 and the bifilar shield winding 13 being closely wound. Also the capacitance $C_{12}$ between the primary and secondary windings 17 and 12 is minimized since the distance between the primary winding 17 and the secondary winding 12 is increased by insulating material 15, thereby reducing the level of the secondary induction noise voltage $V_2$.

Moreover, since the high voltage 16 increases the electric potential difference between the primary winding 17 and the secondary winding 12, so that the capacitance $C_{12}$ is minimized even more, thereby reducing the level of the secondary induction noise voltage $V_2$.

Since the secondary winding 12 is multi-shielded, it can better shield the high frequency current-property noise than the conventional one in case that the high frequency current-property noise is in the range between 10 KHz to 60 KHz, and since the distance between the primary winding 17 and the secondary winding 12 is increased to form a proper leakage path so that a surge impedance is maintained high, the suppressing capability for the pulse-property noise is increased in the event a pulse-property noise enters the primary winding 17.

Since the noise-shielded transformer according to the present invention has a configuration in which the bifilar shield winding 13 and the high voltage winding 16 are wound in turn, the winding work becomes easier, and the electromagnetic and electrostatic shielding capability is considerably enhanced since the bifilar shield winding 13 has a close-winding configuration. Although in the preceding description the conductive plate 14 is isolated with one of its ends inside, the conductive plate 14 also can be overlapped after isolating inside.

Further, in the embodiment described, although the bifilar shield winding 13 and the conductive plate 14 are mounted in turn, the order of mounting these two members may be changed.

As described above in detail, according to the present invention since the secondary winding 12 is located inside, the assembling work is easier and the noise shielding effect is increased. By the multiple shielding of the bifilar shield winding 13 and the conductive plate 14 the capacitance between $C_{2e}$ the secondary winding and the ground is increased and the capacitance $C_{12}$ between the primary winding 17 and the secondary winding 12 is lowered, so that the noise eliminating characteristic with respect to the pulse-property noise and high frequency-property noise is substantially enhanced. It is also possible to obtain a grounding effect and a noise-bypass effect by virtue of the resonance condenser 19 connected to one side of the bifilar shield winding. Also, the present invention has an effect of suppressing the noise conduction by making the electrical potential difference between the primary winding 17 and the secondary winding 12 great by means of the high voltage winding 16.

What is claimed is:

1. A noise-shielded transformer comprising:

a toroidal core;

a secondary winding uniformly wound around the whole magnetic path field of the toroidal core;

a bifilar shield winding wound around said secondary winding, one end of which being grounded and the other end being connected to a resonance condenser;

a conductive plate adapted to wrap the bifilar shield winding so as not to be one-turn shorted;

an insulating member for wrapping the conductive plate;

a high voltage winding wound around the insulating member, both ends of which being floated; and a primary winding uniformly wound around the high voltage winding.

2. The noise-shielded transformer as claimed in claim 1 wherein the number of turns of the bifilar shield winding and the primary winding is same as the number of turns of the secondary winding, and the number of turns of the high voltage winding is greater than the number of turns of the second winding.

3. A noise-shielded transformer comprising:

a toroidal core;

a secondary winding uniformly wound around the whole magnetic path field of the toroidal core;

a conductive plate wrapped around the secondary winding so as not to be one-turn shorted;

a bifilar shield winding wound around said conductive plate;

one end of said bifilar winding being grounded and the other end being connected to a resonance condenser;

an insulating member for wrapping the conductive plate;

a high voltage winding wound around the insulating member, with both ends of said high voltage winding being floated; and a primary winding uniformly wound around the high voltage winding.

4. The noise-shielded transformer as claimed is claim 3, wherein the bifilar shield winding is connected in inverse series.

5. The noise-shielded transformer as claimed in claim 3, wherein the number of turns of the bifilar shield winding and the primary winding is same as the number of turns of the secondary winding, and the number of turns of the high voltage winding is greater than the number of turns of the second winding.

6. A noise-shielded transformer comprising:

a toroidal core;

a secondary winding wound around the toroidal core;

a bifilar shield winding wound around said secondary winding, with one end of said bifilar shield being grounded and the other end being connected to a resonance condenser;

a conductive plate adapted to wrap the bifilar shield winding so as not to be one-turn shorted;

an insulating member for wrapping the conductive plate;

a high voltage winding wound around the insulating member, both ends of which being floated;

a primary winding wound around the toroidal core; and said secondary winding being wound around the high voltage winding.

* * * * *